US008414317B1

(12) United States Patent
Gong et al.

(10) Patent No.: US 8,414,317 B1
(45) Date of Patent: Apr. 9, 2013

(54) CONNECTOR ASSEMBLY HAVING AN APPARATUS WITH TWO ROTATABLE MEMBERS PIVOTALLY CONNECTED FOR PLUGGING OR UNPLUGGING A CONNECTOR

(75) Inventors: Xin-Hu Gong, Shenzhen (CN); Ju-Wen Dai, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/303,156

(22) Filed: Nov. 23, 2011

(51) Int. Cl.
*H01R 13/627* (2006.01)

(52) U.S. Cl.
USPC ..... 439/172

(58) Field of Classification Search ..... 439/172, 439/350–354, 367
See application file for complete search history.

(56) References Cited

U.S. PATENT DOCUMENTS 7,354,291 B2 * 4/2008 Caveney et al. ..... 439/344
7,438,584 B2 * 10/2008 Caveney et al. ..... 439/344
7,578,690 B2 * 8/2009 Caveney et al. ..... 439/344
8,025,514 B1 * 9/2011 Wang ..... 439/172
8,038,456 B1 * 10/2011 Wang ..... 439/172
8,215,972 B2 * 7/2012 Wang ..... 439/172
8,286,932 B2 * 10/2012 Peng et al. ..... 248/694
8,308,498 B2 * 11/2012 Adams ..... 439/304
2011/0049319 A1 * 3/2011 Peng et al. ..... 248/309.1
2012/0176743 A1 * 7/2012 Gong et al. ..... 361/679.33

* cited by examiner

*Primary Examiner* — Chandrika Prasad
(74) *Attorney, Agent, or Firm* — Altis Law Group, Inc.

(57) ABSTRACT

A connector assembly includes a connector and an assisting apparatus for plugging or unplugging the connector. The connector includes a connecting portion having a resilient tab. The assisting apparatus includes a hollow first rotatable member, and a second rotatable member received in the first rotatable member. The middle of opposite sides of the second rotatable member are pivotably connected to opposite sides of the first rotatable member. The connecting portion is arranged between front sections of the first and second rotatable members, with a front end of the connecting portion exposed out of the first and second rotatable members. When a rear end of the second rotatable member is rotated towards the first rotatable member, the front section of the second rotatable member is rotated towards the first rotatable member and deforms the resilient tab.

16 Claims, 5 Drawing Sheets

CONNECTOR ASSEMBLY HAVING AN APPARATUS WITH TWO ROTATABLE MEMBERS PIVOTALLY CONNECTED FOR PLUGGING OR UNPLUGGING A CONNECTOR

BACKGROUND

1. Technical Field

The present disclosure relates generally to a connector assembly having an assisting apparatus for plugging or unplugging a connector of the connector assembly.

2. Description of Related Art

Some connectors, such as registered Jack-45 (RJ-45) connectors, each have a resilient tab for latching the connector with a socket. However, operating the resilient tab to plug or unplug the connector manually in relation to the socket can be difficult and inconvenient because of limited operational space.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
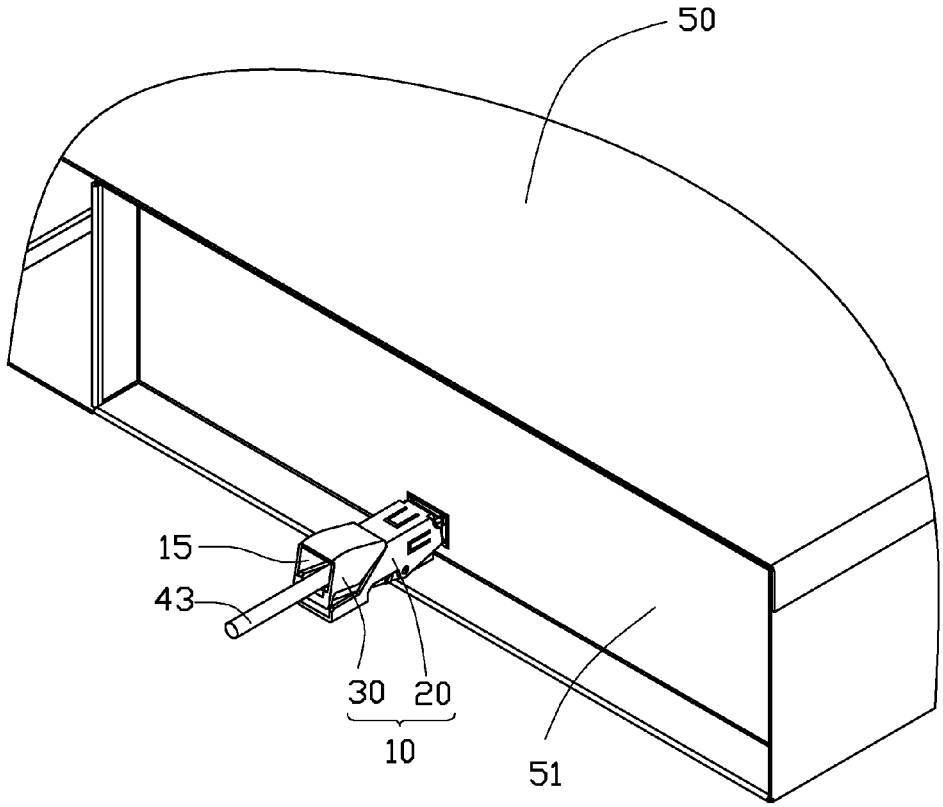
FIG. 1 is an assembled, isometric view of an exemplary embodiment of a connector assembly together with an electronic device.
Figure 2:
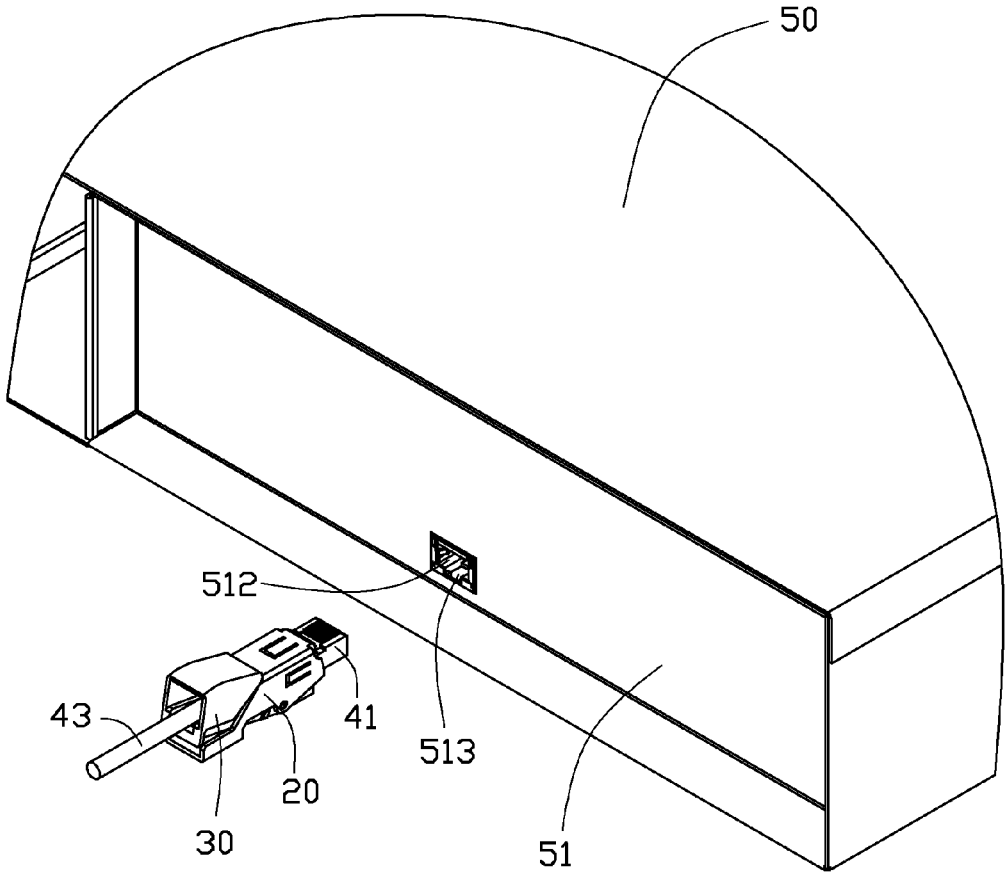
FIG. 2 is an isometric view of the connector assembly and the electronic device of FIG. 1, showing the connector assembly unplugged from the electronic device.
Figure 3:
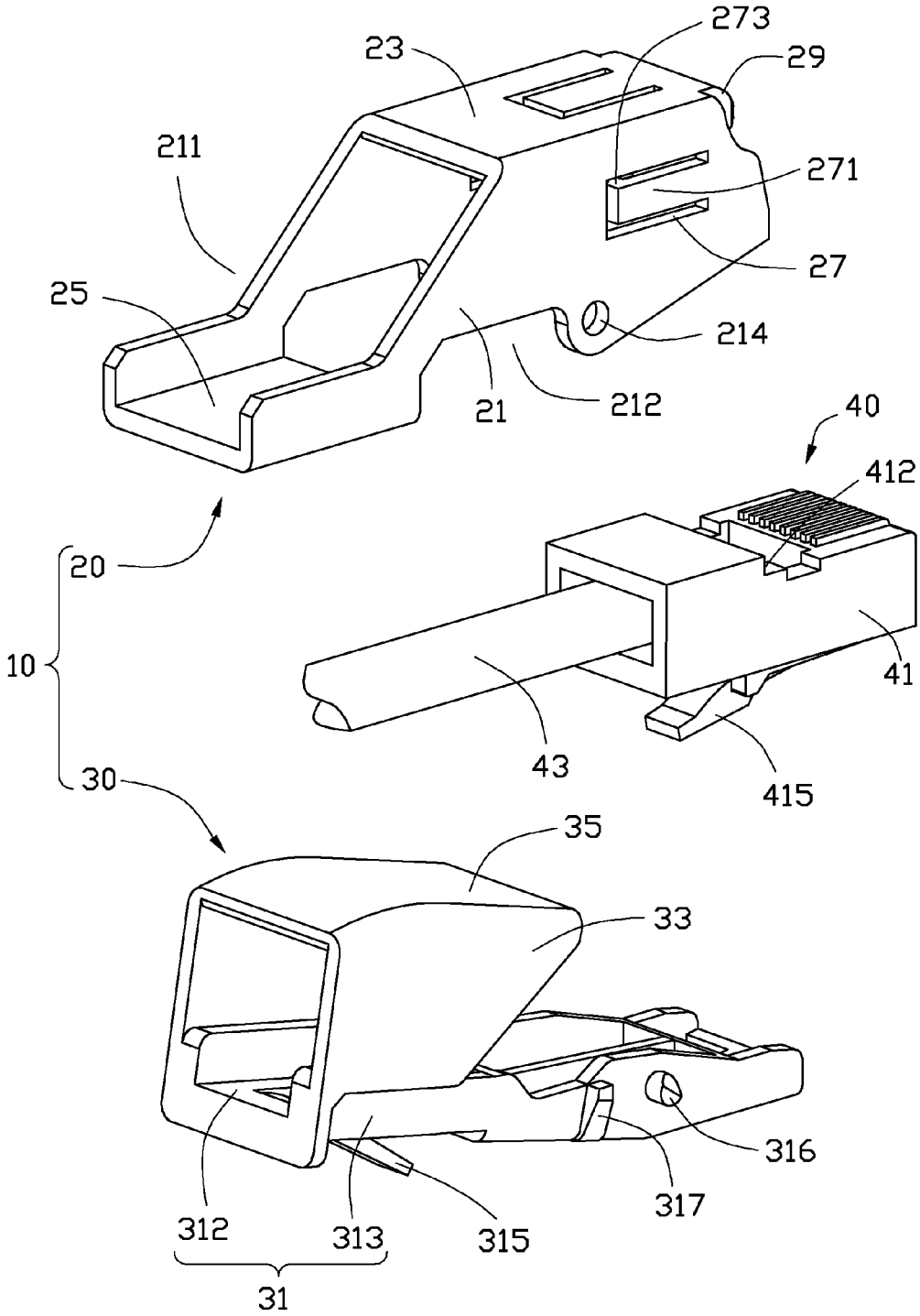
FIG. 3 is an exploded, isometric view of the connector assembly of FIG. 2.

Referring to FIGS. 1 to 3, an exemplary embodiment of a connector assembly is provided to be plugged in a connector socket 512 of an electronic device 50. The electronic device 50 includes a side plate 51. The connector socket 512 is exposed through the side plate 51. A latching slot 513 is defined in the bottom of the connector socket 512. The connector assembly includes a connector 40 and an assisting apparatus 10 for plugging or unplugging the connector 40.

In the embodiment, the connector 40 is a Registered Jack-45 (RJ-45) connector. The connector 40 includes a connecting portion 41, and a cable 43 connected to the rear end of the connecting portion 41. A step surface 412 facing forward is formed on a middle of the top of the connecting portion 41. A resilient tab 415 slantingly extends down from the bottom of the connecting portion 41.

The assisting apparatus 10 includes a hollow first rotatable member 20 and a second rotatable member 30.

The first rotatable member 20 includes two opposite first sidewalls 21, a first top wall 23 perpendicularly connected between front sections of the tops of the first sidewalls 21, and a first bottom wall 25 perpendicularly connected between rear sections of the bottoms of the first sidewalls 21. The first bottom wall 25 is substantially parallel to the first top wall 23. A cutout 211 is defined in each first sidewall 21 above the first bottom wall 25. A pivot hole 214 is defined in each first sidewall 21, adjacent to a middle of the bottom of the first sidewall 21. A notch 212 is defined in the bottom of each first sidewall 21 between the corresponding pivot hole 214 and the first bottom wall 25. A section of the bottom of each first sidewall 21 in front of the corresponding notch 212 gradually slantingly extends up. A supporting portion 215 (see FIG. 4) protrudes inwards from a lower section of the inner surface of each first sidewall 21, parallel to the first top wall 23. The supporting portions 215 are respectively arranged above the pivot holes 214. A through slot 27 is defined in each of the first top wall 23 and the first sidewalls 21. The through slots 27 of the first sidewalls 21 are respectively arranged above the supporting portions 215. Each of the first top wall 23 and the first sidewalls 21 forms a resilient latch 271 extending rearwards from a section adjoining the front end of the corresponding through slot 27. A latching portion 237 extends into the corresponding through slot 27 from the rear end of each latch 271. A stop plate 29 extends down from the front end of the first top wall 23.

The second rotatable member 30 includes an elongated abutting portion 31. The abutting portion 31 includes a second bottom wall 312, and two flanges 313 respectively extending up from two opposite sides of the second bottom wall 312. A resilient arm 315 slantingly extends down from the second bottom wall 312, adjacent to the rear end of the second bottom wall 312. The outer surface of each flange 313 forms a pivot 316 adjacent to a middle of the flange 313, and a block 317 between the pivot 316 and the resilient arm 315. A second sidewall 33 extends out and up from a rear section of the top of each flange 313. A second top wall 35 is connected between the tops of the second sidewalls 33.

Figure 4:
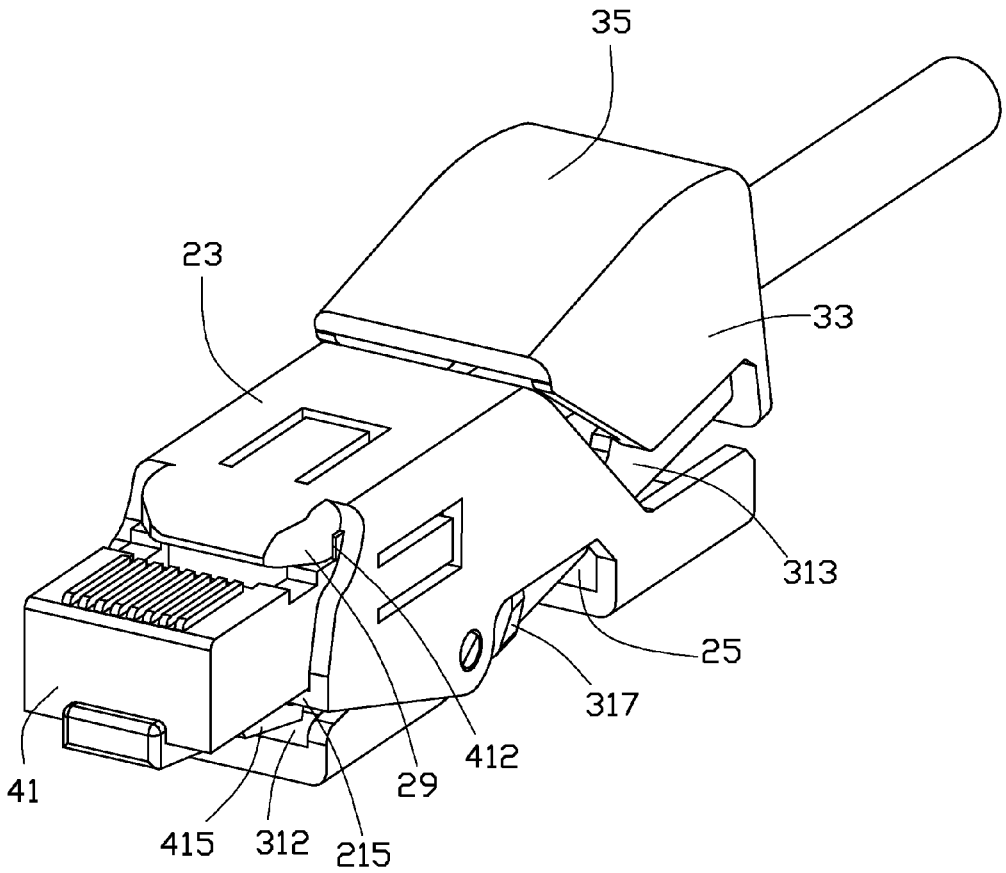
FIGS. 4 and 5 are assembled, isometric views of the connector assembly of FIG. 3 in different states.
Figure 5:
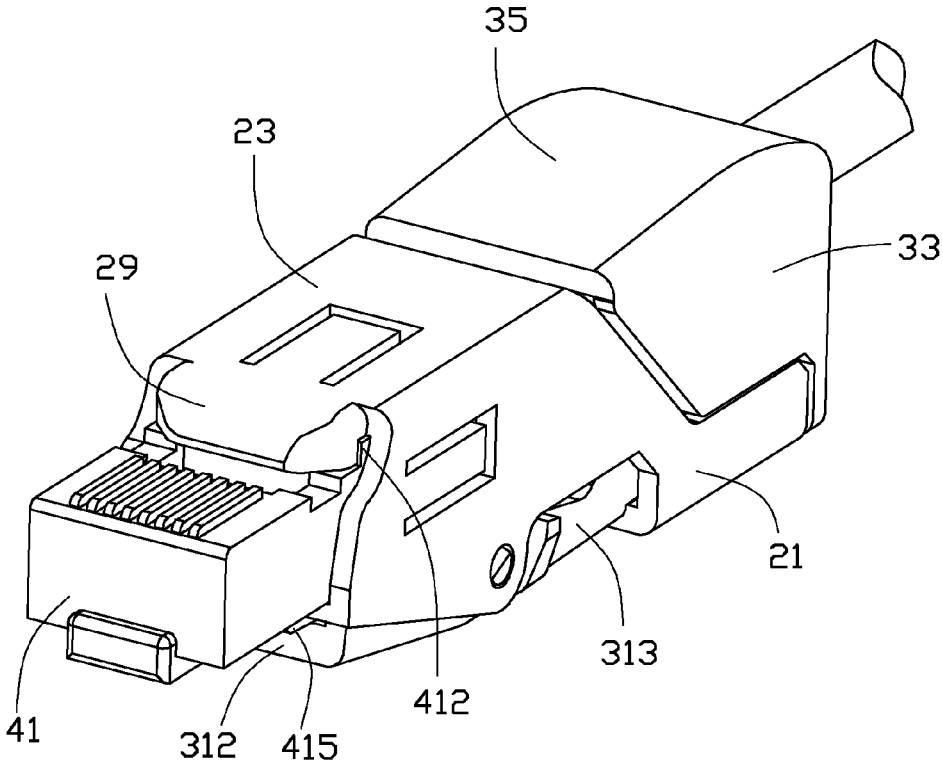

Referring to FIGS. 4 and 5, to assemble the connector assembly, the front end of the abutting portion 31 is inserted into the first rotatable member 20 from the rear side of the first rotatable member 20, with the front end of the abutting portion 31 arranged below the supporting portions 215. The pivots 316 are respectively rotatably engaged in the pivot holes 214. Thereby, the second rotatable member 30 is rotatably connected to the first rotatable member 20. The assisting apparatus 10 is assembled. The resilient arm 315 abuts against the top surface of the first bottom wall 25, to drive the second rotatable member 30 to rotate and form an angle between the abutting portion 31 and the first bottom wall 25. The rear end of the abutting portion 31 is tilted up relative to the first bottom wall 25, and the front end of the abutting portion 31 is tilted down relative to the first top wall 23. The second sidewalls 33 are respectively received in the cutouts 211, and the front end of the second top wall 35 engages with the rear end of the first top wall 23. The first and second rotatable members 20 and 30 bound a receiving space 15 (see FIG. 1). The blocks 317 are respectively received in the notches 212. When the rear end of the second rotatable member 30 is rotated upwards relative to the first rotatable member 20, the blocks 317 can engage with the portions of the first sidewalls 21 adjoining the tops of the notches 212, and prevent the second rotatable member 30 from overly rotating upwards.

The second top wall 35 is pressed down relative to the first rotatable member 20, to allow the rear end of the second rotatable member 30 to rotate downwards, and to allow the front end of the second rotatable member 30 to rotate upwards. The resilient arm 315 is deformed. When the bottoms of the second sidewalls 33 abut against the tops of the rear sections of the first sidewalls 21, the second bottom wall 312 is substantially parallel to the first top wall 23 and the first bottom wall 25. The connecting portion 41 is inserted into the receiving space 15 from the rear side of the assisting apparatus 10, with the bottom of the connecting portion 41 supported on the supporting portions 215. The latching portions 273 abut against the connecting portion 41, with the latches 271 deformed outwards. When the step surface 412 abuts against the stop plate 29, the latches 271 are restored to allow the latching portions 273 to engage with the rear end of the connecting portion 41. Thereby, the connector 40 is fixed to the first rotatable member 20. The front end of the connecting portion 41 is exposed out of the front end of the first and second rotatable members 20 and 30. The resilient tab 415 abuts against the front section of second bottom wall 312 and is deformed upwards.

When the second rotatable member 30 is released, the resilient arm 315 is restored to push the rear end of the abutting portion 31 to rotate upwards relative to the first bottom wall 25. The front end of the abutting portion 31 is rotated downwards to make the resilient tab 415 be restored.

Referring to FIGS. 1 and 2, to plug the connector 40 in the electronic device 50, the rear ends of the first and second rotatable members 20 and 30 are rotated towards each other, to allow the resilient arm 315 to be deformed. The front end of the abutting portion 31 is rotated towards the first top wall 23, and the resilient tab 415 is deformed. The front end of the connecting portion 41 is inserted into the connector socket 512. The rear ends of the first and second rotatable members 20 and 30 are released, and the resilient arm 315 is restored to push the rear end of the abutting portion 31 to rotate upwards, and allow the front end of the abutting portion 31 to rotate downwards. The resilient tab 415 is restored downwards and engages in the latching slot 513. Thereby, the connector 40 is fixed to the connector socket 512.

To unplug the connector 40 from the connector socket 512, the rear end of the second rotatable member 30 is pressed towards the first rotatable member 20. The front end of the abutting portion 31 is rotated upwards and deforms the resilient tab 415, to allow the resilient tab 415 to disengage from the latching slot 513. The assisting apparatus 10 is pulled away from the electronic device 50. The connecting portion 41 can be detached from the connector socket 512.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. An assisting apparatus for plugging or unplugging a connector having a resilient tab, the assisting apparatus comprising:

a hollow first rotatable member comprising two opposite first sidewalls, a first top wall connected between front sections of tops of the first sidewalls, and a first bottom wall connected between rear sections of bottoms of the first sidewalls; and a second rotatable member comprising an abutting portion received in the first rotatable member, wherein the first and second rotatable members bound a receiving space for receiving the connector, the abutting portion comprises a second bottom wall, and two flanges respectively extending up from two opposite sides of the second bottom wall, middles of the flanges are respectively and pivotably connected to middles of the first sidewalls, when a rear end of the second bottom wall is pressed down towards the first bottom wall, the abutting portion is rotated to allow a front end of the second bottom wall to move upwards towards the first top wall to press up the resilient tab.

2. The assisting apparatus of claim 1, wherein a resilient arm slantingly extends down from a rear section of the second bottom wall, to abut against a top of the first bottom wall.

3. The assisting apparatus of claim 2, wherein a cutout is defined in each first sidewall above the first bottom wall, a second sidewall extends out and up from a rear section of a top of each flange, a second top wall is connected between tops of the second sidewalls, the second sidewalls are respectively received in the cutouts, a front end of the second top wall engages with a rear end of the first top wall.

4. The assisting apparatus of claim 2, wherein a pivot hole is defined in each first sidewall adjacent to a middle of the bottom of the first sidewall, a pivot protrudes from a middle of an outer surface of each flange, the pivots of the flanges are respectively and rotatably engaged in the pivot holes of the first sidewalls.

5. The assisting apparatus of claim 4, wherein a notch is defined in the bottom of each first sidewall between the corresponding pivot hole and the first bottom wall, a block protrudes from the outer surface of each flange between the corresponding pivot and the resilient arm, the blocks of the flanges are respectively received in the notches of the first sidewalls, to respectively abut against portions of the first sidewalls adjoining tops of the notches when a rear end of the second rotatable member is rotated away from the first bottom wall.

6. The assisting apparatus of claim 1, wherein a supporting portion protrudes inwards from a lower section of an inner surface of each first sidewall, for supporting the connector.

7. The assisting apparatus of claim 6, wherein a stop plate extends down from a front end of the first top wall, for engaging with a top of the connector.

8. The assisting apparatus of claim 7, wherein a through slot is defined in each of the first top wall and the first sidewalls, the through slots of the first sidewalls are arranged above the supporting portions, each of the first top wall and the first sidewalls forms a resilient latch extending rearwards from a section adjoining a front end of the corresponding through slot, and a latching portion extends into the corresponding through slot from a rear end of each latch, for engaging with a rear end of the connector.

9. A connector assembly, comprising:

a connector comprising a connecting portion, and a resilient tab slantingly extending down from a bottom of the connecting portion; and an assisting apparatus for plugging or unplugging the connector, the assisting apparatus comprising a hollow first rotatable member, and a second rotatable member, the first rotatable member comprising two opposite first sidewalls, a first top wall connected between front sections of tops of the first sidewalls, and a first bottom wall connected between rear sections of bottoms of the first sidewalls, the second rotatable member comprising an abutting portion received in the first rotatable member;

wherein middles of opposite sides of the abutting portion are respectively and pivotably connected to middles of the first sidewalls, the connecting portion of the connector is arranged between the first top wall and a front section of the abutting portion, with a front end of the connecting portion exposed out of the first and second rotatable members, and the resilient tab aligning with the front section of the abutting portion, when a rear end of the abutting portion is pressed towards the first bottom wall, the front section of the abutting portion is rotated towards the connecting portion and deforms the resilient tab to unplug the connector.

10. The connector assembly of claim 9, wherein a supporting portion protrudes inwards from a lower section of an inner surface of each first sidewall, the connecting portion of the connector is sandwiched between the first top wall and the supporting portions.

11. The connector assembly of claim 10, wherein a step surface facing forward is formed on a middle of a top of the connecting portion, a stop plate extends down from a front end of the first top wall, to engage with the step surface of the connecting portion.

12. The connector assembly of claim 11, wherein a through slot is defined in each of the first top wall and the first sidewalls, the through slots of the first sidewalls are arranged above the supporting portions, each of the first top wall and the first sidewalls forms a resilient latch extending rearwards from a section adjoining a front end of the corresponding through slot, and a latching portion extends into the corresponding through slot from a rear end of each latch, to engage with a rear end of the connecting portion.

13. The connector assembly of claim 9, wherein a resilient arm slantingly extends down from a rear section of the abutting portion, to abut against a top of the first bottom wall.

14. The connector assembly of claim 13, wherein a cutout is defined in each first sidewall above the first bottom wall, two second sidewalls respectively extend out and up from rear sections of tops of the opposite sides of the abutting portion, to be respectively received in the cutouts, a second top wall is connected between tops of the second sidewalls, a front end of the second top wall engages with a rear end of the first top wall.

15. The connector assembly of claim 13, wherein a pivot hole is defined in each first sidewall adjacent to a middle of the bottom of the first sidewall, a pivot protrudes from a middle of each of the opposite sides of the abutting portion, the pivots of the abutting portion are respectively and rotatably engaged in the pivot holes of the first sidewalls.

16. The connector assembly of claim 15, wherein a notch is defined in the bottom of each first sidewall between the corresponding pivot hole and the first bottom wall, a block protrudes from each of the opposite sides of the abutting portion between the corresponding pivot and the resilient arm, the blocks are respectively received in the notches of the first sidewalls, to respectively abut against portions of the first sidewalls adjoining tops of the notches when the rear end of the abutting portion is rotated away from the first bottom wall.

* * * * *

UNITED STATES PATENT AND TRADEMARK OFFICE

CERTIFICATE OF CORRECTION

PATENT NO. : 8,414,317 B1
APPLICATION NO. : 13/303156
DATED : April 9, 2013
INVENTOR(S) : Xin-Hu Gong et al.

It is certified that error appears in the above-identified patent and that said Letters Patent is hereby corrected as shown below:

On the Title Page, insert below Item (22)

--(30) Foreign Application Priority Data

Sep. 30, 2011 (CN) .....2011 1 0292594--.

Signed and Sealed this
Twenty-fourth Day of December, 2013

Margaret A. Focarino

Margaret A. Focarino
*Commissioner for Patents of the United States Patent and Trademark Office*